US011731295B2

(12) United States Patent
Arndt et al.

(10) Patent No.: US 11,731,295 B2
(45) Date of Patent: Aug. 22, 2023

(54) MULTI-PIECE HAIR CLIPPER CONSTRUCTION WITH METAL OUTER HOUSING

(71) Applicant: WAHL CLIPPER CORPORATION, Sterling, IL (US)

(72) Inventors: Steven Wayne Arndt, Geneseo, IL (US); Nathaniel Douglas Craig, Walnut, IL (US); Daniel Michael Saathoff, Sterling, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 253 days.

(21) Appl. No.: 17/122,741

(22) Filed: Dec. 15, 2020

(65) Prior Publication Data

US 2022/0184827 A1 Jun. 16, 2022

(51) Int. Cl.
*B26B 19/06* (2006.01)
*B26B 19/20* (2006.01)
*B26B 19/38* (2006.01)

(52) U.S. Cl.
CPC ..... *B26B 19/063* (2013.01); *B26B 19/20* (2013.01); *B26B 19/3846* (2013.01)

(58) Field of Classification Search
None
See application file for complete search history.

(56) References Cited

U.S. PATENT DOCUMENTS 3,520,059 A * 7/1970 Gringer ..... B26B 5/005 30/340
3,783,508 A 1/1974 Brown et al.
4,660,283 A * 4/1987 Yasunaka ..... B26B 19/04 74/49
5,189,792 A * 3/1993 Otsuka ..... B26B 19/38 30/41.6
5,193,275 A * 3/1993 Hirokazu ..... B26B 19/28 30/43
5,237,750 A * 8/1993 Nakano ..... B26B 19/20 30/200
5,786,061 A 7/1998 Banfield
5,787,587 A 8/1998 Wahl et al.
6,112,414 A * 9/2000 Andis ..... B26B 19/3833 30/DIG. 1
7,239,053 B2 7/2007 Brill
8,276,279 B2 10/2012 Heckman et al.
9,561,596 B2 2/2017 Buck, Jr.
10,059,013 B2 8/2018 Skuhra
10,518,427 B2 12/2019 Skuhra
2006/0042093 A1 3/2006 Dirks et al.
(Continued)

OTHER PUBLICATIONS

International Search Report and Written Opinion received for PCT/US2021/072806, dated Mar. 17, 2022.

*Primary Examiner* — Hwei-Siu C Payer
(74) *Attorney, Agent, or Firm* — Greer, Burns & Crain, Ltd

(57) ABSTRACT

A hair clipper is provided, including a chassis having upper and lower chassis portions defining an enclosed interior chamber, said upper and lower chassis portions configured for being secured together; and an outer housing including upper and lower housing portions constructed and arranged for enclosing the chassis as the housing portions are secured together such that the interior chamber is isolated from the housing.

27 Claims, 21 Drawing Sheets

(56) References Cited

U.S. PATENT DOCUMENTS

| | | | | |
|---|---|---|---|---|
| 2007/0107230 | A1* | 5/2007 | Baron | B26B 19/14 30/43.6 |
| 2008/0197258 | A1 | 8/2008 | Werman et al. | |
| 2008/0282550 | A1* | 11/2008 | Piwaron | B26B 19/3846 30/228 |
| 2009/0065425 | A1 | 3/2009 | Jiang | |
| 2022/0184827 | A1* | 6/2022 | Arndt | B26B 19/20 |
| 2022/0234227 | A1* | 7/2022 | Fan | B26B 19/28 |

* cited by examiner

MULTI-PIECE HAIR CLIPPER CONSTRUCTION WITH METAL OUTER HOUSING

BACKGROUND

The present invention relates to electric hair cutting devices, commonly known as hair clippers or hair trimmers, and more specifically relates to a multi-component hair clipper construction featuring metal outer housing pieces.

Conventional electrically-powered hair clippers and trimmers, collectively referred to here as hair clippers, feature an inner chassis to which a motor, electronic controls, batteries or AC power cords and bladeset power transmission linkage are mounted. This structure is then covered by an outer housing, typically upper and lower clamshell-like portions which are held to the chassis by threaded fasteners. In most cases, the outer housing is made of molded plastic pieces.

An ongoing performance objective of hair clipper designers is the reduction of motor and bladeset vibration and noise. Another objective is the reduction in parts for production and assembly cost savings.

A more recent interest to designers is the ability to replace traditional plastic housings with metal housings. A challenge here is that metal housings are less forgiving of variations in tolerances compared to plastic parts. As such, achieving a high quality, aesthetically pleasing, close fit of components which are assembled in a factory setting is a significant challenge for clipper designers. In addition, modern hair clippers often feature housings with separate ornamental pieces made of metal, plastic or plastic with metal or foil plating that are preferably closely fit to the housing. The resulting challenge for hair clipper designers is the balancing of many, often opposing design considerations, accommodating multiple pieces having varying tolerances for achieving an aesthetically appealing appearance, and also securing operating components in a way to reduce vibration and noise.

Accordingly, there is a need for an improved hair clipper construction that addresses the above-listed design criteria.

SUMMARY

The above-listed need is met or exceeded by the present multi-piece hair clipper construction, which includes a core chassis having upper and lower portions configured for encasing the motor and electronic control components and a portion of the bladeset power transmission assembly. Further, since the chassis is preferably made of plastic, the internal clipper components (motor, switch, circuitry, power cords, etc.) are protected from electrical interference with the preferably metal housing portions, including upper and lower portions, which enclose the chassis. In the preferred embodiment, the housing is made of cast, polished aluminum, however other metals are contemplated, as well as plastics or selected engineered materials incorporating blends of known materials. By employing the present clipper construction, the relatively high voltage of 120-230V of the preferred clipper motor is electrically isolated from the metal housing.

Included in the lower chassis portion is a motor recess constructed and arranged for accommodating the electric motor, which is preferably a vibrator type, however other motors known in the hair clipper art are considered suitable. Also included in the lower chassis are integral crush ribs that hold the motor in place in a friction fit, which tightens as the chassis is assembled. Depending wedges on the upper chassis portion are engaged in cavities in the crush ribs to further tighten the motor in place as the chassis portions are secured together. Threaded fasteners capture the motor between the upper and lower chassis portions, without tightly restraining the motor. That function is performed by the crush ribs, which are wedged further against the motor as the upper chassis is tightened into place. Since the motor is securely held within the upper and lower chassis portions, the present assembly has been found to reduce motor operational noise and vibration compared to conventional clipper assembly technology. As such, in the present clipper, the motor is electrically isolated from the metal clipper housing.

Also included on the lower chassis is an integral blade guide channel that replaces a separate metal bracket found on conventional hair clippers. The blade guide channel is defined by a formation at a blade end of the chassis that also defines a travel path for a cam follower. As is known in the art, the cam follower travels transversely to a longitudinal axis of the clipper, and parallel to movement of a moving blade of the bladeset. A third function of the blade guide channel is defining an angular seat for a forward edge of the lower clipper housing, which, as described above is preferably made of metal.

In addition, relatively soft, rubber-like grips provided for user comfort are attached to the chassis on sides of the clipper. These grips create compression zones for accommodating variations in the metal housing tolerances so that the housing and grips are secured together without unsightly gaps or misalignments. In other words, the grips are dimensioned to be slightly oversize, and are configured to compress without bulging as the upper and lower housing portions are fastened to the chassis. In the preferred embodiment, each grip is loosely clipped along upper and lower edges to the assembled chassis using a hook and loop system. In a preferred embodiment, the hook and loop connection system includes at least one ramped hook on the chassis, and at least one complementary loop on the grip, each hook being surrounding by a landing receiving the hook. Also, in an embodiment, the grip has at least one loop projecting from an upper edge, and at least one loop projecting from a lower edge. Further, each grip includes at least one supplemental gripping formation on at least one of a front end and a rear end, and the chassis is configured for receiving each supplemental gripping formation in a snap-fit engagement.

By loosely holding the grips to the chassis, the grips can move or "float" to accommodate variations in the rigid metal housing portions. The grip material compresses as needed as the upper and lower housing portions are secured to each other with the chassis captured between them.

Yet another feature of the present clipper is a fastening system for retaining ornamental badges or decorative pieces to a metal clipper housing so that a tight, aligned fit is achieved without the use of threaded fasteners. Achieving such a fit is challenging, given the variability of dimensions of cast and polished metal housing portions. The decorative piece is provided with at least one and preferably a plurality of cantilevered hook projections that extend into an interior of the clipper. A retainer is placed on an underside of the housing configured with a plurality of complementary projections that engage the hook projections of the decorative piece in a snap-fit relationship. In a preferred embodiment, the retainer includes two types of projections, a first plurality of planar projections, and a second plurality of doglegged projections, the latter of which are configured for exerting a preloaded clamping force on the projections of the decorative piece.

In an embodiment, the chassis includes a projection recess for accommodating the hook and said retainer projections. Also, the upper and lower housing portions are provided with mounting bosses configured for projecting through complementary throughbores in the chassis, so that fasteners passing through the bosses tightly retain the chassis between the upper and lower housing portions. Also, at least one of the housing portions includes at least one locating formation projecting from an interior of the housing portion, and matingly engaging a complementary at least one receiving formation in the chassis.

More specifically, a hair clipper is provided, including a chassis having upper and lower chassis portions defining an enclosed interior chamber, the upper and lower chassis portions configured for being secured together; and an outer housing including upper and lower housing portions constructed and arranged for enclosing the chassis as the housing portions are secured together such that the interior chamber is isolated from the housing.

In another embodiment, a hair clipper is provided, including a chassis having upper and lower chassis portions defining an enclosed interior chamber, the upper and lower chassis portions configured for being secured together. An outer housing includes upper and lower housing portions constructed and arranged for enclosing the chassis as the housing portions are secured together such that the interior chamber is isolated from the housing. The interior chamber includes a motor recess, and a motor held in the motor recess through tight cooperation of complementary formations on the upper and lower chassis portions; and resilient grip formations loosely connected to the chassis, and constructed and arranged to be compressed upon assembly of the upper and lower housing portions.

In still another embodiment, a method for assembling a hair clipper includes providing a chassis having upper and lower chassis portions defining an enclosed interior chamber, said upper and lower chassis portions configured for being secured together; providing an outer housing including upper and lower housing portions constructed and arranged for enclosing the chassis as the housing portions are secured together such that the interior chamber is isolated from the housing; providing the chassis with a first, blade end, and a second, rear end, and the blade end includes an integral blade guide channel. The blade guide channel is incorporated into a formation that defines a housing receiving surface oriented at an oblique angle to an axis defined by the chassis, and the lower housing portion has an angled front edge that is slidably engaged along the housing receiving surface.

DETAILED DESCRIPTION

Figure 1:
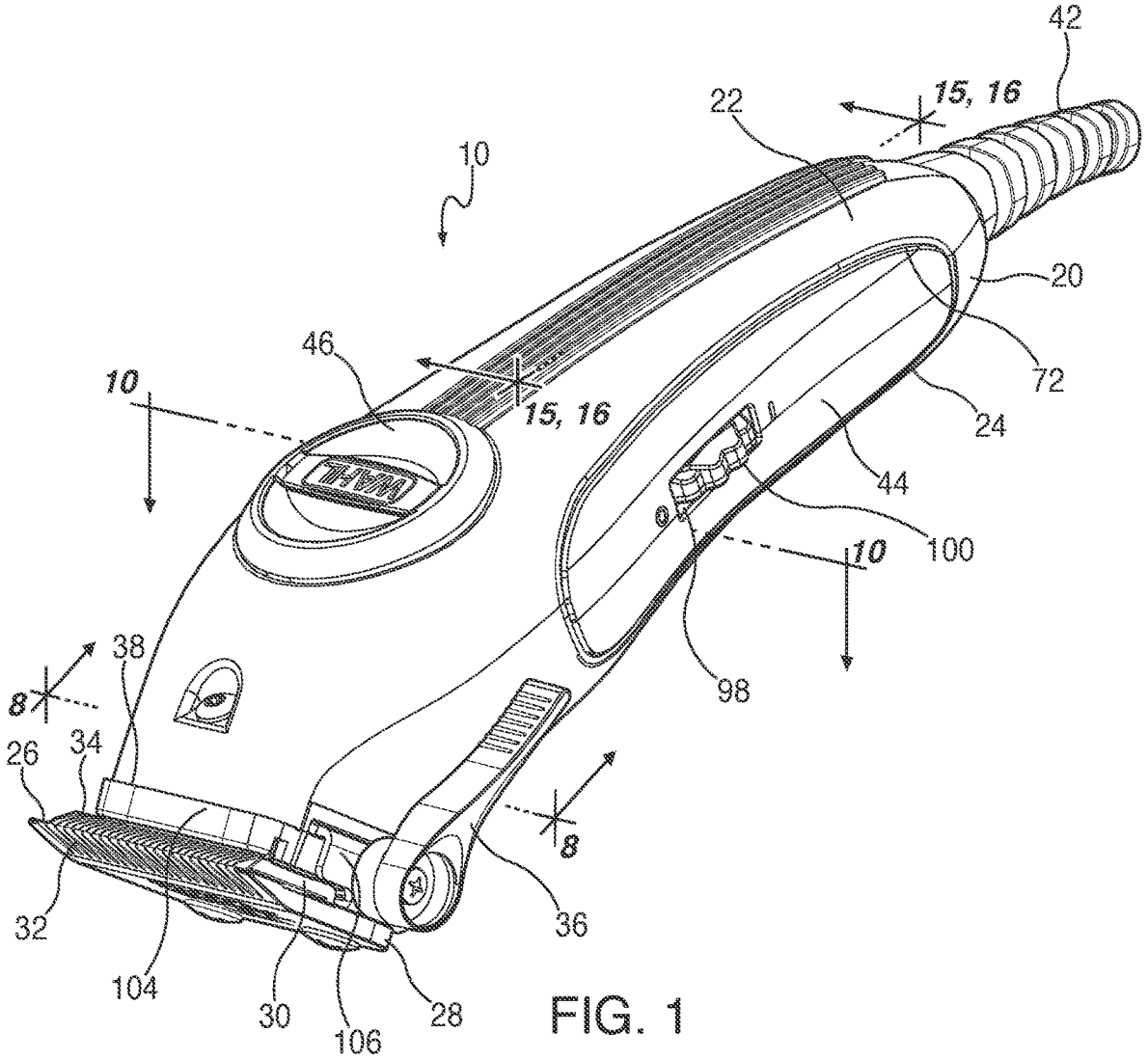
FIG. 1 is a top perspective assembled view of the present hair clipper.
Figure 2:
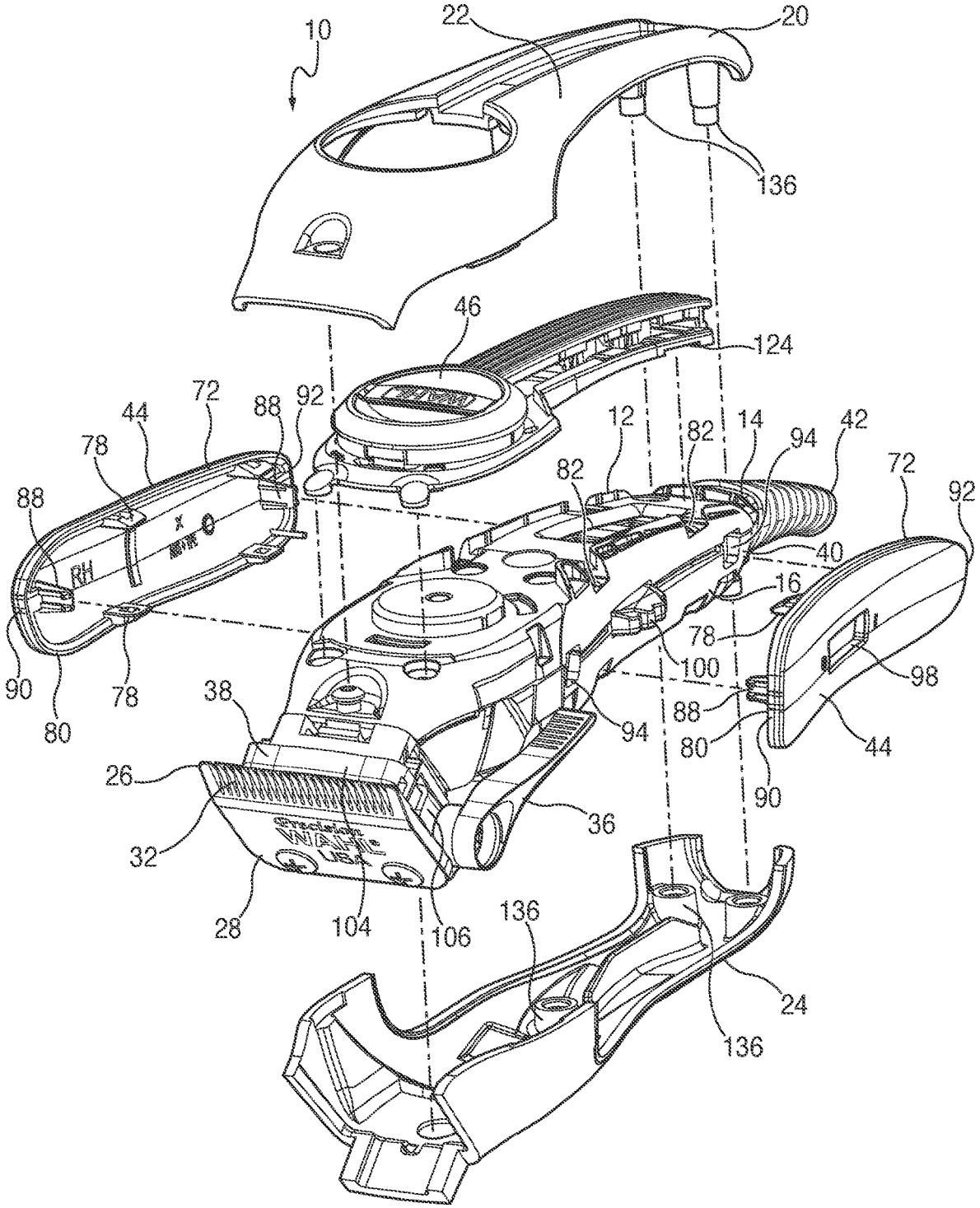
FIG. 2 is an exploded perspective view of the hair clipper of FIG. 1.
Figure 3:
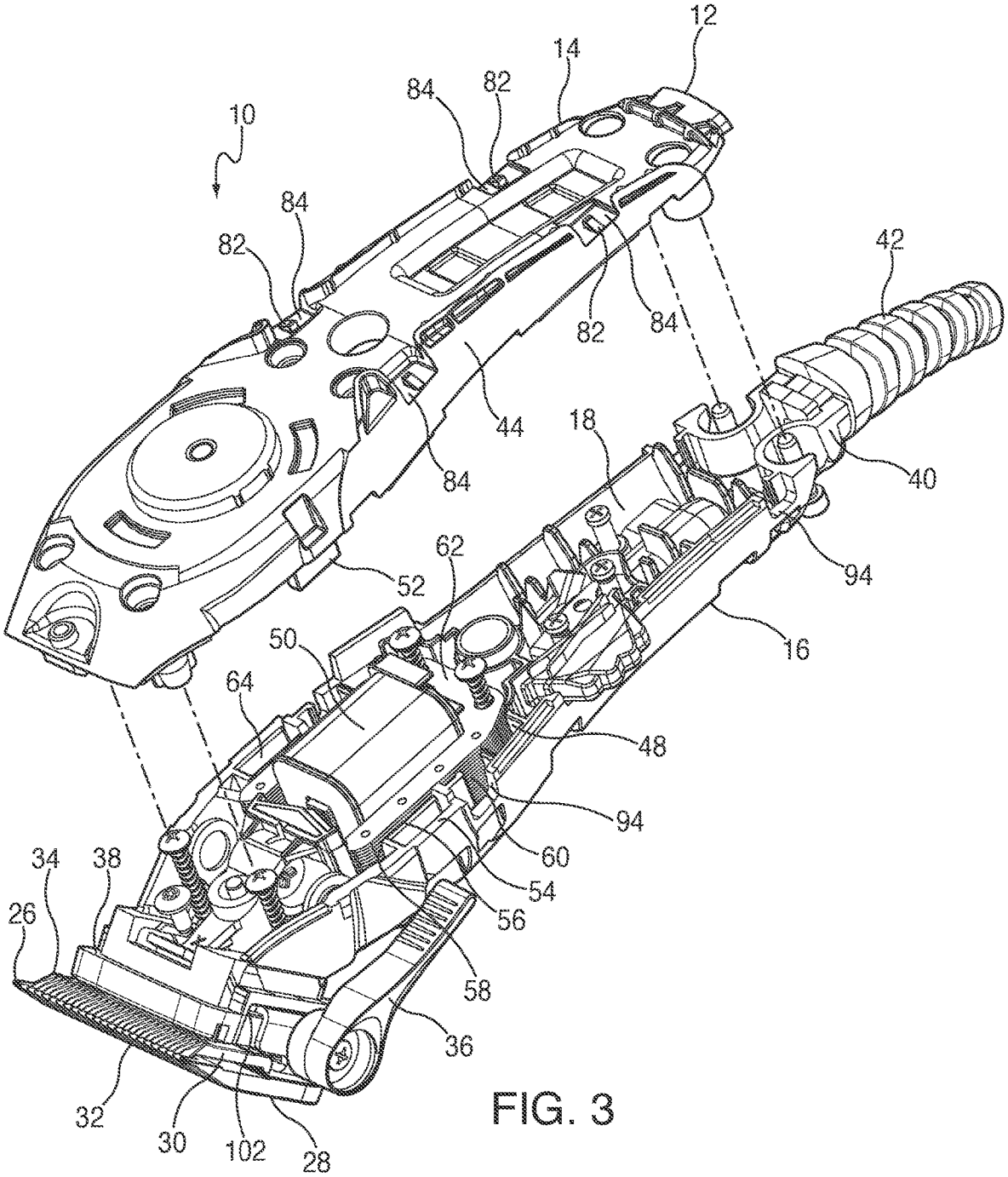
FIG. 3 is an exploded perspective view of the chassis of the present hair clipper.

Referring now to FIGS. 1-3, the present hair clipper is generally designated 10, and includes a chassis 12 having upper and lower chassis portions 14, 16 defining an enclosed interior chamber 18 (FIG. 3). The upper and lower chassis portions 14, 16 are constructed and arranged for being fastened together, as with threaded fasteners or the like. For the purposes of this application, "upper" and "lower" refer to the orientation of the hair clipper 10 as seen in the drawings, which is the same as the clipper would be as it rests on a substrate such as a table or stylist work station. Other orientations of the clipper 10 are contemplated during use.

Enclosing the chassis 12 is an outer housing 20 including upper and lower housing portions 22, 24 constructed and arranged for enclosing the chassis 12 as the housing portions are secured together such that the interior chamber 18 is isolated from the housing. In the preferred embodiment, the chassis 12 is made of electrically insulative material such as injection molded plastic or the like, and the outer housing 20 is made of metal, preferably cast and polished aluminum or the like, or other metals or composite materials known in the art. As described in greater detail below, the chassis 12 is provided with several features for accommodating variations in dimensions of the outer housing 20 caused by the casting and polishing process, so that the hair clipper 10 is easily assembled and the respective components are fully aligned for a quality appearance.

As known in the art, the hair clipper 10 is also provided with a bladeset 26 including a stationary blade 28 and a laterally reciprocating moving blade 30, each blade having a corresponding plurality of teeth 32, 34. Cutting action occurs as the moving blade 30 reciprocates relative to the stationary blade 28. An adjustment lever 36 is connected to the chassis 12 and to the stationary blade 28 and is configured for moving the stationary blade relative to the moving blade 30 as is known in the art.

The chassis 12 has a first or bladeset end 38 and a second, opposite or rear end 40. At the rear end 40, a cord protector 42 is secured to the chassis 12 for protecting a power cord as is known in the art. It is contemplated that the present hair clipper 10 is powered by AC wall current, or by battery power, in which case the cord protector 42 is eliminated.

Between the upper and lower housing portions 22, 24 are located relatively resilient, rubber-like grips 44 described in greater detail below. Also included on the outer housing 20, and preferably on the upper housing portion 22 is a decorative piece or ornamental badge 46, also described in greater detail below.

Referring now to FIGS. 3 and 8-11, within the interior chamber 18 of the chassis 12 is a motor recess 48 dimensioned for accommodating an electric motor 50, preferably a vibrator motor of the type described in commonly-owned U.S. Pat. Nos. 5,787,587; 7,239,053; and 8,276,279, all of which are incorporated by reference and such motors are well known in the art. However, other types of electric motors commonly used in hair clippers are contemplated. One of the features of the present clipper 10 is that the motor 50 is held in place in the interior chamber 18 of the chassis 12 so that operational noise and vibrations are reduced, and that the motor is installed with reduced labor compared to conventional hair clippers. To this end, the motor 50 is held in the motor recess 48 through tight cooperation of complementary formations 52, 54 respectively on said upper and lower chassis portions 14, 16, however it is contemplated that the disposition of the formations may be reversed depending on the application.

Figure 11:
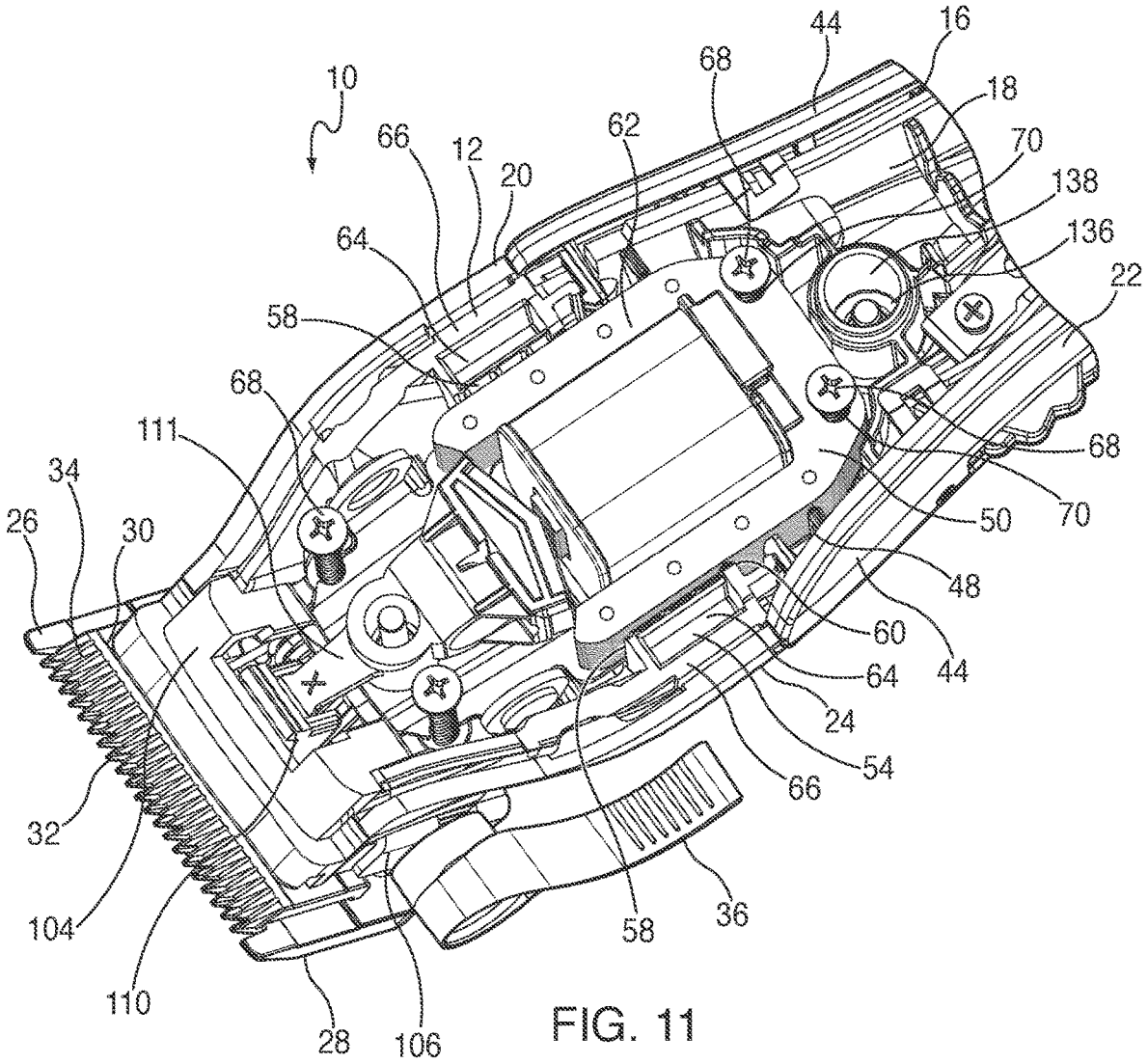
FIG. 11 is an enlarged, fragmentary top view of the present hair clipper, with portions omitted for clarity.
Figure 12:
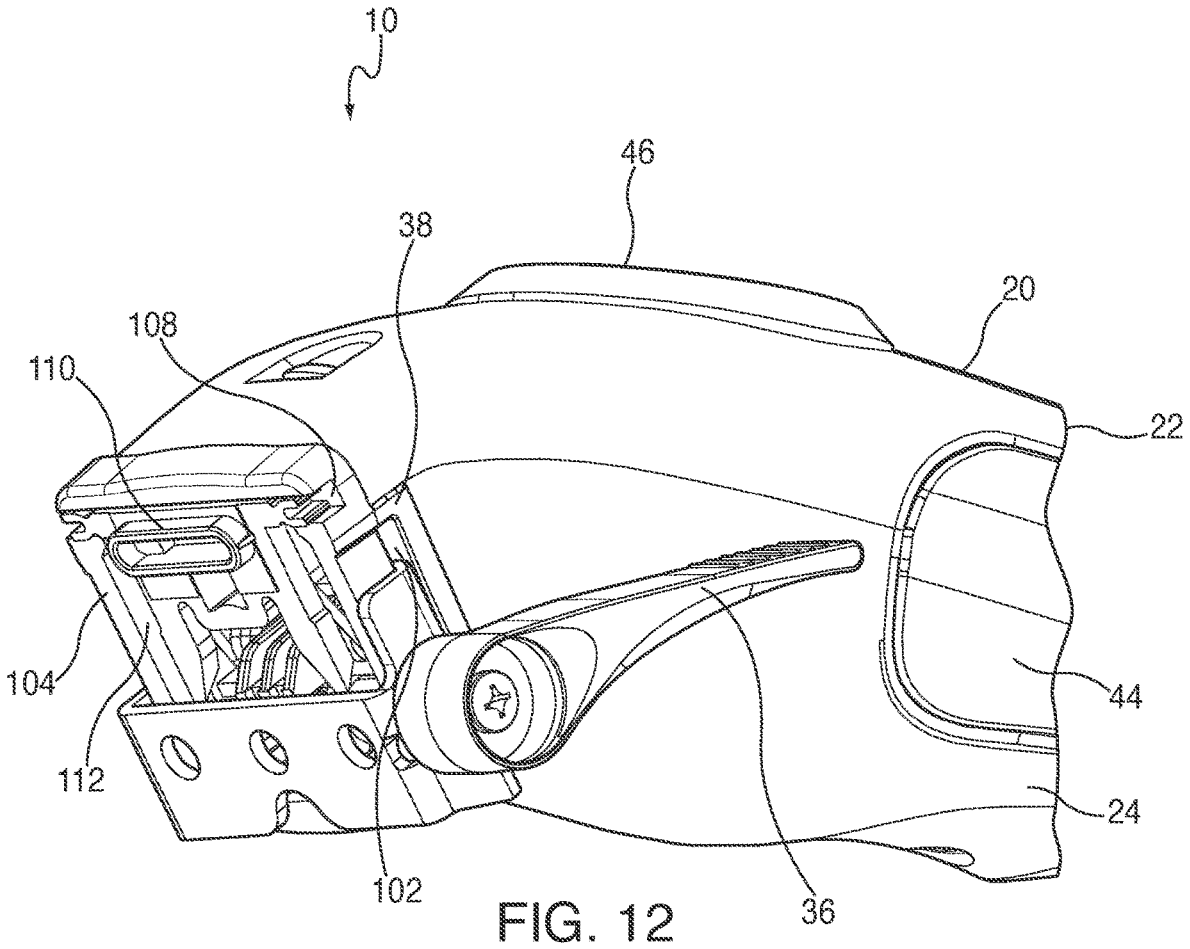
FIG. 12 is a fragmentary front perspective view of the present hair clipper, with portions omitted for clarity.

In an embodiment, the complementary formations 52, 54 (FIGS. 3, 8 and 10) include crush ribs 56 integrally formed on the lower chassis portion 16. More specifically, the crush ribs 56 include an inner wall 58 configured for tightly and slidingly engaging an outer surface 60 of laminations 62 of the motor 50. Behind the inner wall 58 is defined a cavity 64 enclosed in part by an outer wall 66 of the chassis portion 16. On the upper chassis portion 14, the formations 52 take the form of depending wedges on the other of the chassis portions, the wedges being engaged in the cavities 64 in the crush ribs. The wedges 52 and the cavities 64 are constructed and arranged so that as the upper and lower chassis portions 14, 16 are secured together around the motor 50, the wedges 52 increase the holding force of the crush ribs 56 on the motor. The action of the complementary formations 52, 54 is the main structure holding the motor 50 within the motor recess 48. In addition, the hair clipper 10 is provided with threaded fasteners 68 used to secure the chassis portions 14, 16 together. As seen in FIGS. 9 and 11, the fasteners 68 are loosely accommodated within throughbores 70 in the motor 50, and as such locate the motor within the motor recess. Referring now to FIGS. 2, 4, 5, 7 and 18, another feature of the present hair clipper 10 is the use of the resilient grips 44 to accommodate manufacturing variations of the upper and lower housing portions 22, 24 so that the final assembly has an aesthetically pleasing appearance without unsightly gaps between components. As such, the grips 44 are dimensioned with a slightly oversize peripheral edge 72 so that corresponding edges 74, 76 of the upper and lower housing portions 22, 24 exert a compressive force upon the grips 44 upon assembly.

For enhancing the ability of the grips 44 to accommodate the above-described manufacturing variations, it is preferred that the grips are relatively loosely connected to the chassis. In the preferred embodiment, the connection is achieved by a hook and loop connection system. While it is contemplated that either the grip 44 or the chassis 12 is provided with the hooks and the other component is provided with the loops, in the preferred embodiment, the grips 44 are provided with at least one and preferably a plurality of loops 78 projecting laterally or generally horizontally from an inner surface 80 of the peripheral edge 72. Each of the loops 78 has a relatively large opening 81.

Figure 7:
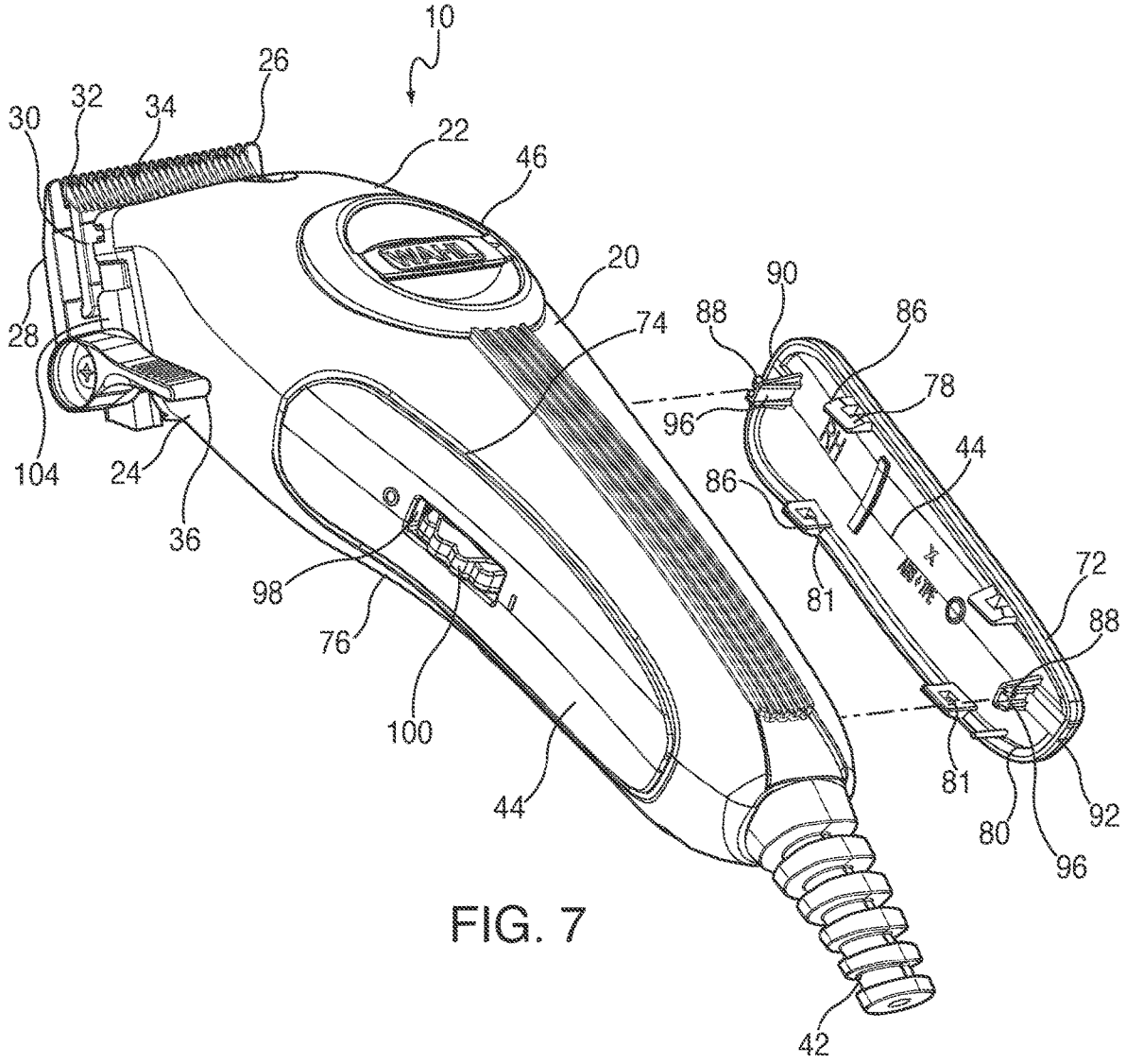
FIG. 7 is a rear partially exploded perspective view of the present hair clipper showing detail of the side grip pads.

Engaging each loop 78 is a ramped hook 82 on the chassis 12, each hook being loosely engaged in the opening 81 and being progressively taller towards a longitudinal axis of the chassis 12. Surrounding each hook 82 is a generally planar landing 84 (FIG. 3) preferably configured for complementarily receiving an exterior edge 86 of the loop 78 (FIG. 7). In the preferred embodiment, each grip 44 has at least one and preferably a pair of the loops 78 projecting from an upper part of the edge 72, and at least one and preferably a pair of the loops 78 projecting from a lower part of the edge 72.

Figure 8:
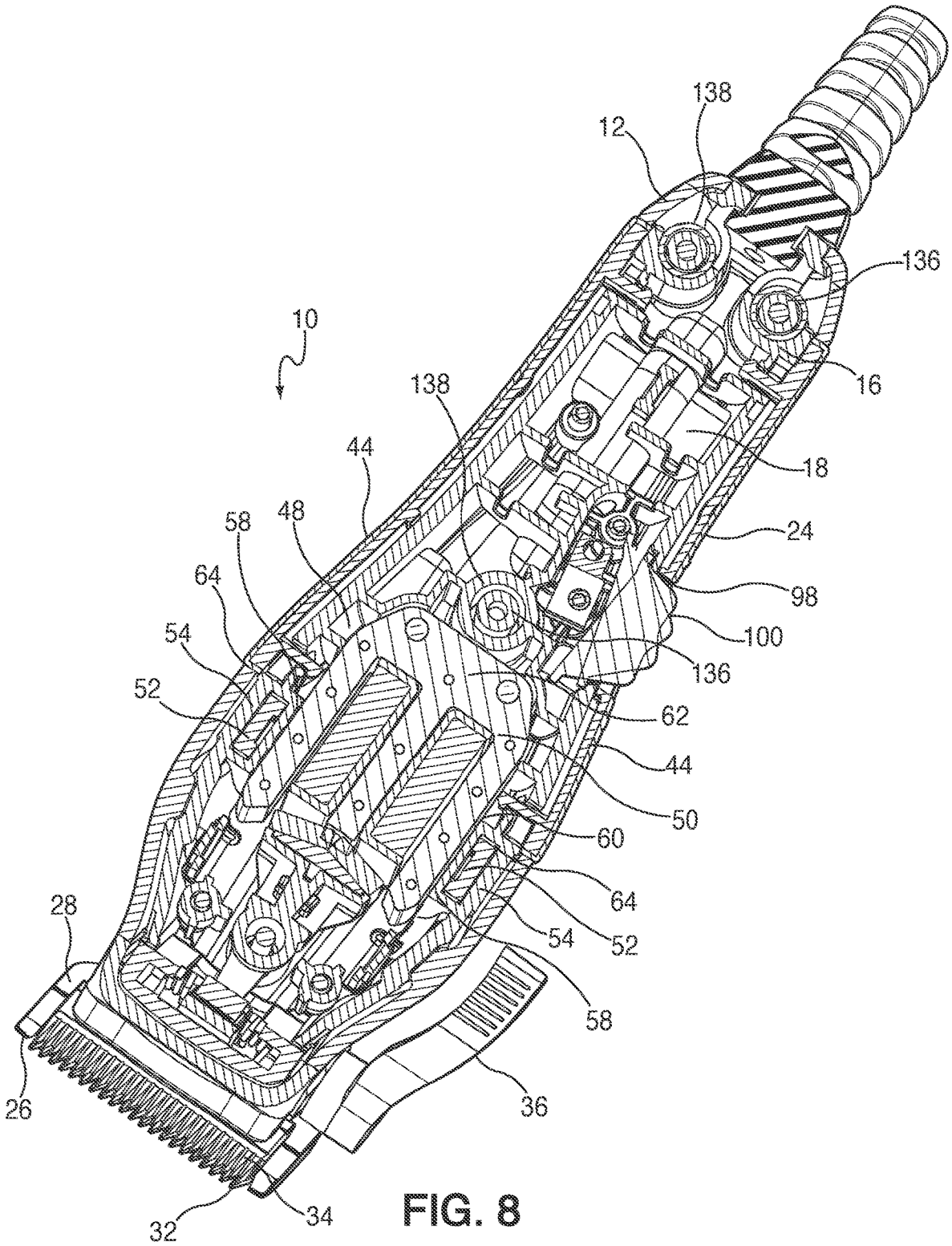
FIG. 8 is a cross-section taken along the lines 8-8 of FIG. 1 and in the direction generally indicated.
Figure 9:
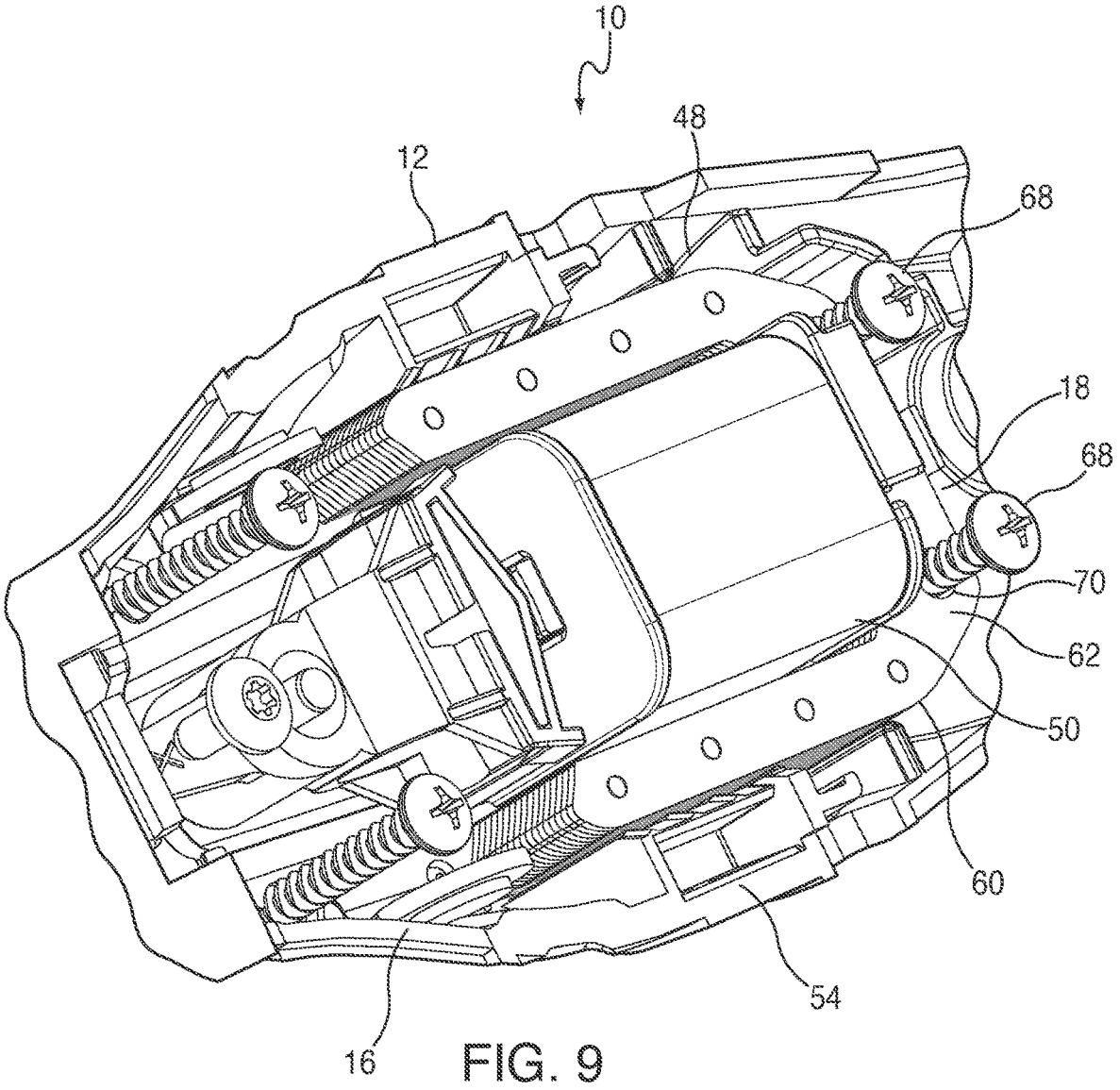
FIG. 9 is an enlarged, fragmentary view of the hair clipper depicted in FIG. 8.
Figure 10:
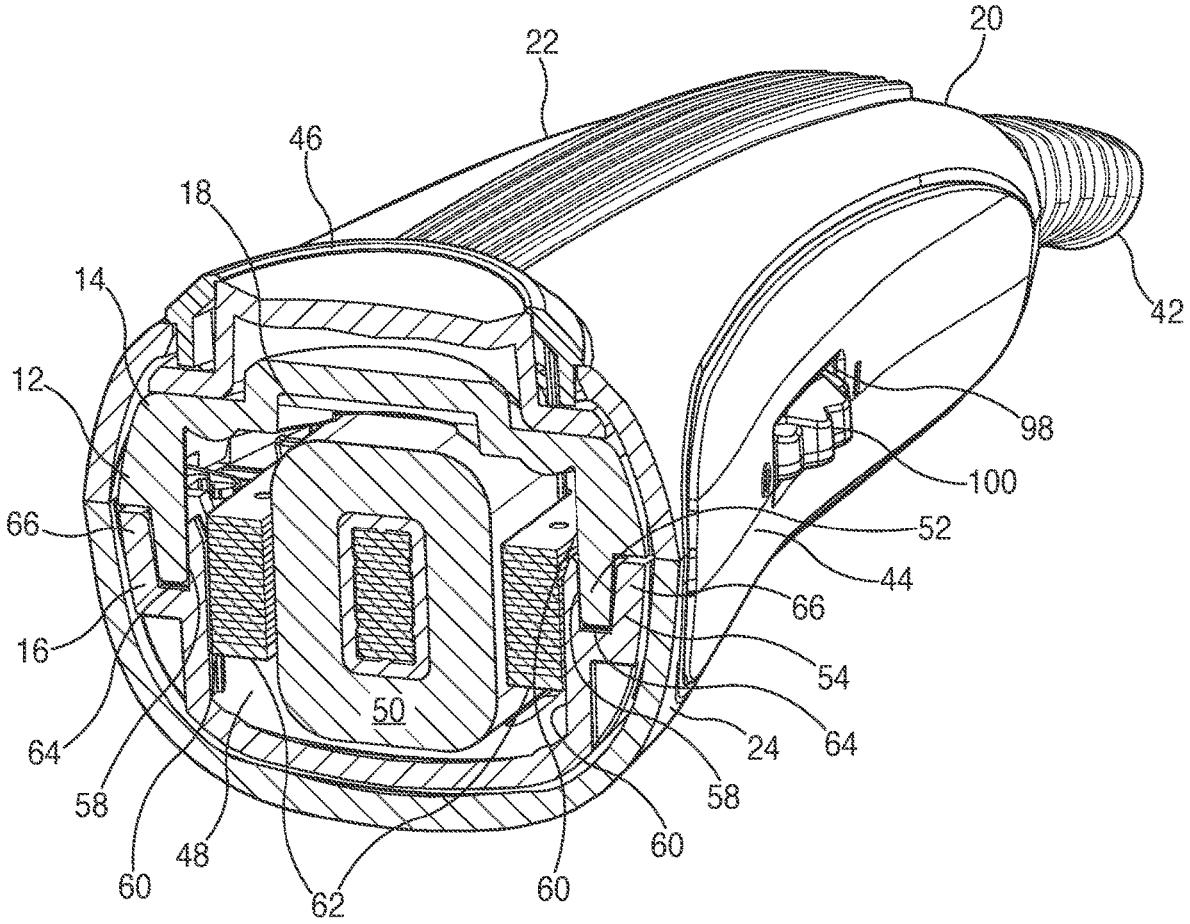
FIG. 10 is a cross-section taken along the line 10-10 of FIG. 1 and in the direction indicated generally.

Referring now to FIGS. 2, 7 and 8, the grips 44 are further secured to the chassis 12 through the use of at least one supplemental gripping formation 88 on at least one of a front end 90 and a rear end 92 of the grip, and the chassis 12 is configured with openings 94 for receiving each supplemental gripping formation in a snap-fit engagement. In the preferred embodiment, the supplemental gripping formations 88 are provided with barbed ends 96 (FIG. 7). As seen in FIG. 7, in the preferred embodiment, one of the grips 44 is provided with an opening 98 for accommodating an ON/OFF switch 100.

Figure 4:
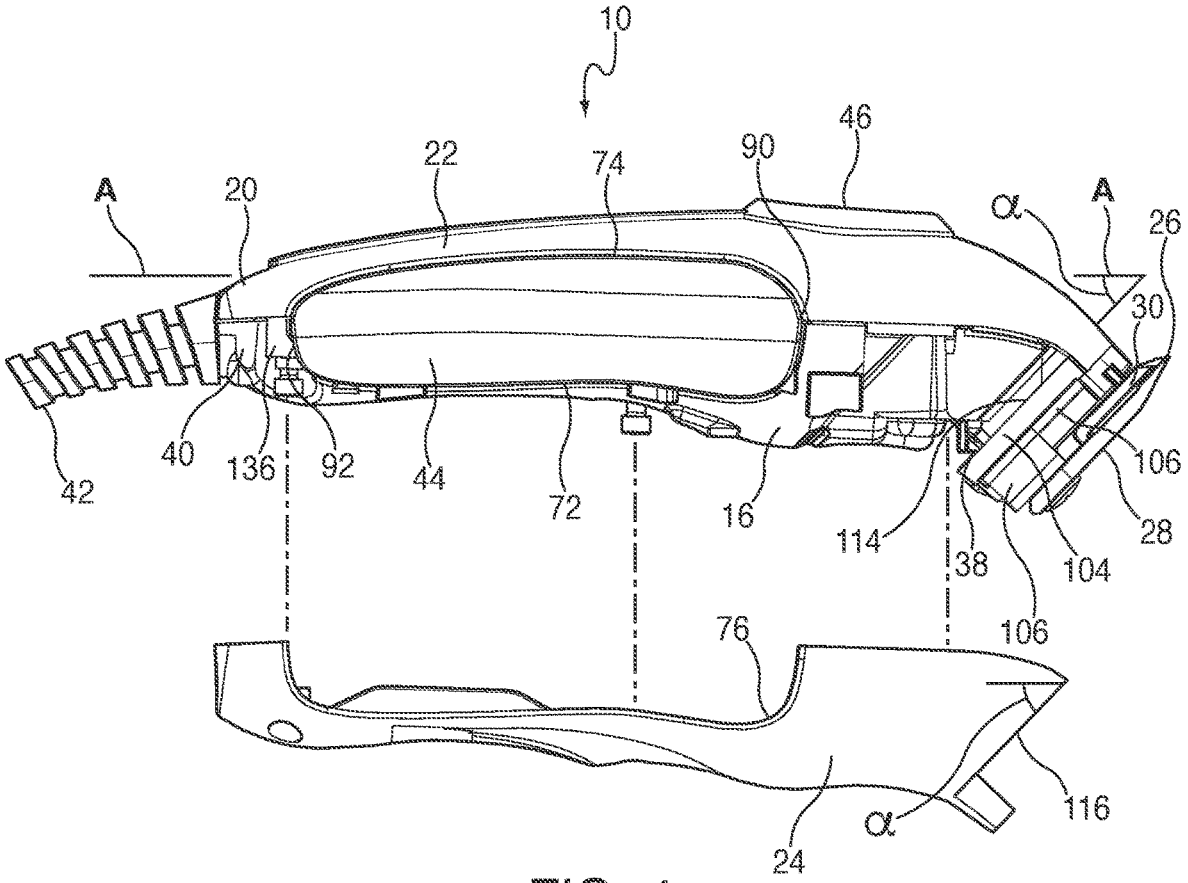
FIG. 4 is a partially exploded side elevation of the present hair clipper.

Referring now to FIGS. 1-6 and 11-14, another feature of the present hair clipper 10 is that the chassis 12 has the first, bladeset or blade end 38, and the second, rear end 40, and the blade end includes an integral blade guide channel 102. As is well known in the art, hair clippers are provided with a supplemental metal guide bracket for slidingly accommodating movement of the stationary blade 28 transverse to the lateral reciprocal cutting motion. In the present clipper 10, the conventional bracket is replaced by the channel 102, which is defined by an enlarged formation 104 oriented at an oblique angle $\alpha$ to the longitudinal axis "A" of the chassis (FIG. 4). While other angles are contemplated, in the preferred embodiment, the angle $\alpha$ is 60°.

Figure 5:
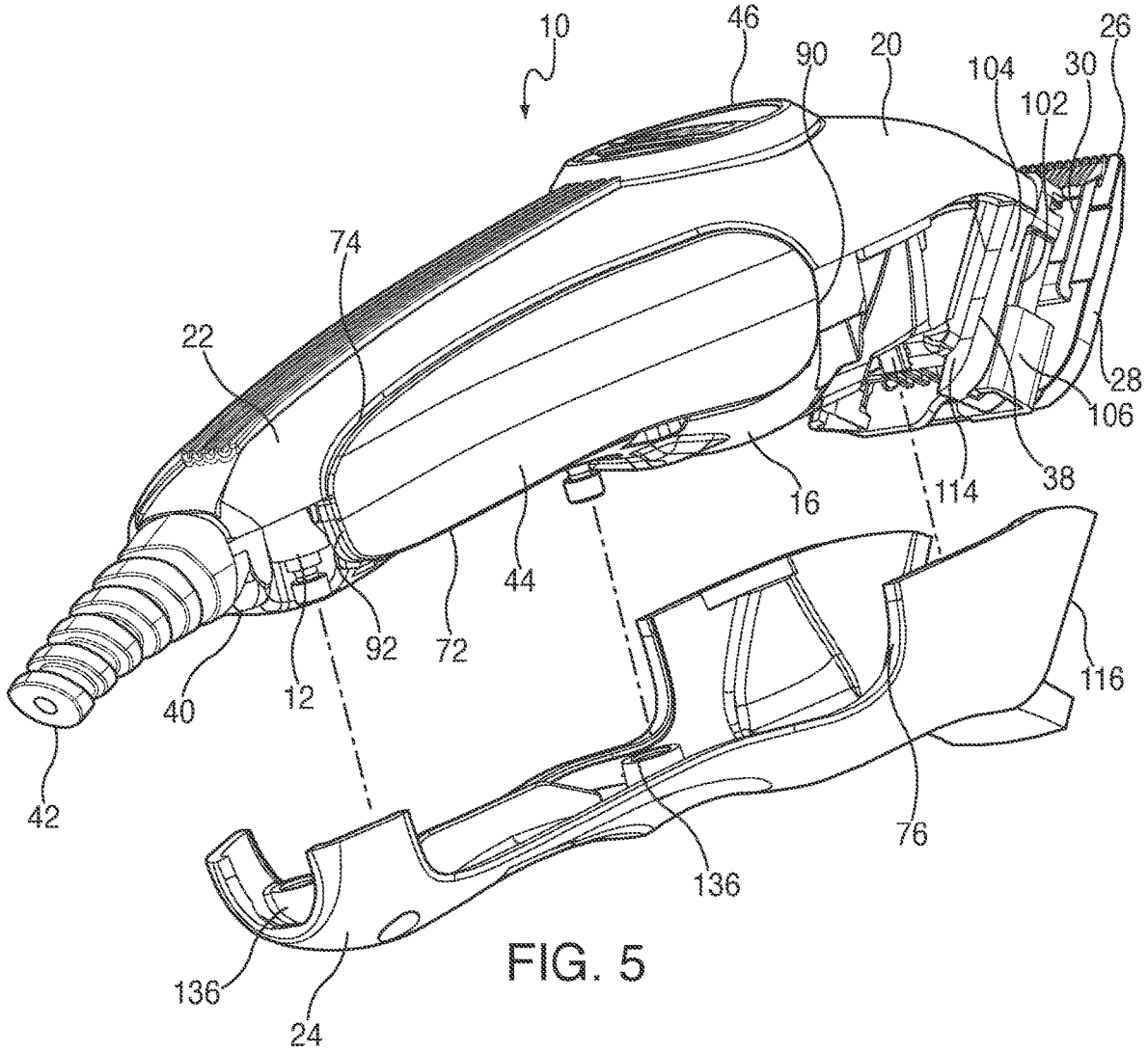
FIG. 5 is rear partially exploded perspective of the hair clipper shown in FIG. 4.
Figure 6:
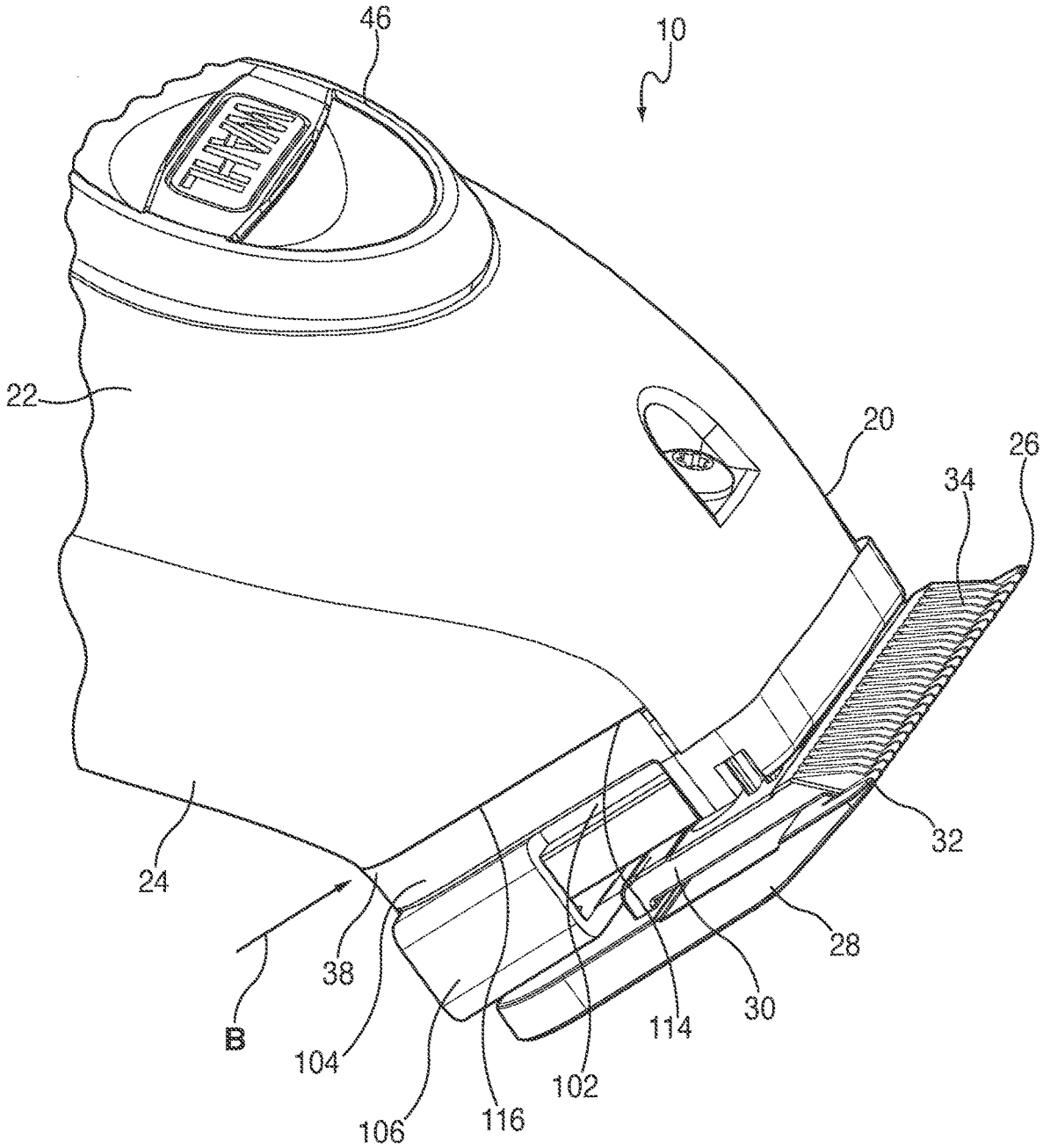
FIG. 6 is an enlarged, fragmentary top perspective view of the present hair clipper showing the bladeset.

As seen in FIGS. 1, 5 and 6, the blade guide channel 102 slidingly receives a generally "U"-shaped bracket 106 secured to the stationary blade 28 and also receiving the adjustment lever 36, which is threadably secured to the formation 104. Through an eccentric cam (not shown) on the adjustment lever 36, movement of the adjustment lever 36 causes sliding action of the bracket 106 and the blade 28 in the channel 102.

Referring now to FIGS. 11-14, another function of the blade end formation 104 is that it defines a travel path 108 for a cam follower 110 used to transfer laterally reciprocating motion from the motor 50 to the moving blade 30, using a drive arm 111 (FIG. 11). The travel path 108 extends transversely to the longitudinal axis of the chassis 12. Further, the formation 104 defines a central opening 112 (FIG. 12) that accommodates the reciprocal movement of the cam follower 110.

Referring now to FIGS. 4-6, still another feature of the formation 104 is defining a housing receiving surface 114 oriented at an oblique angle, preferably angle $\alpha$ for slidably receiving an angled front edge 116 of one of the upper and lower housing portions 22, 24, preferably the lower housing portion 24. During assembly of the hair clipper 10, once the chassis 12 is fastened together, the lower housing portion 24 is slidably engaged upon the lower chassis portion 16 so that the front edge 116 slidably and angularly engages the receiving surface 114 in the direction of the arrow "B" (FIG. 6).

Referring now to FIGS. 16-21, a still further feature of the present hair clipper 10 is the ability for tightly accommodating the separate badge or decorative piece 46, despite variations in manufacturing tolerances of the associated housing portion 22, 24. In the preferred embodiment, the decorative piece 46 is secured to the upper housing portion 22, however, attachment to the lower housing portion 24 is contemplated, depending on the application. Advantageously, the decorative piece 46 is secured to the housing portion 22, 24 without the use of threaded fasteners.

More specifically, the decorative piece 46 is provided with a plurality of hook projections 122 (FIGS. 2, 16, 17 and 21) extending into an interior of the clipper 10, which are snap-fit into a separate retainer 124 positioned on an underside 126 (FIG. 2) of the housing portion 22, 24 receiving the decorative piece. As described above, the housing portion 22, 24 is preferably metal, such as aluminum or the like, and the decorative piece 46 and the retainer 124 are both preferably plastic, the decorative piece 46 is preferably coated with metal or foil as is known in the art.

Figure 20:
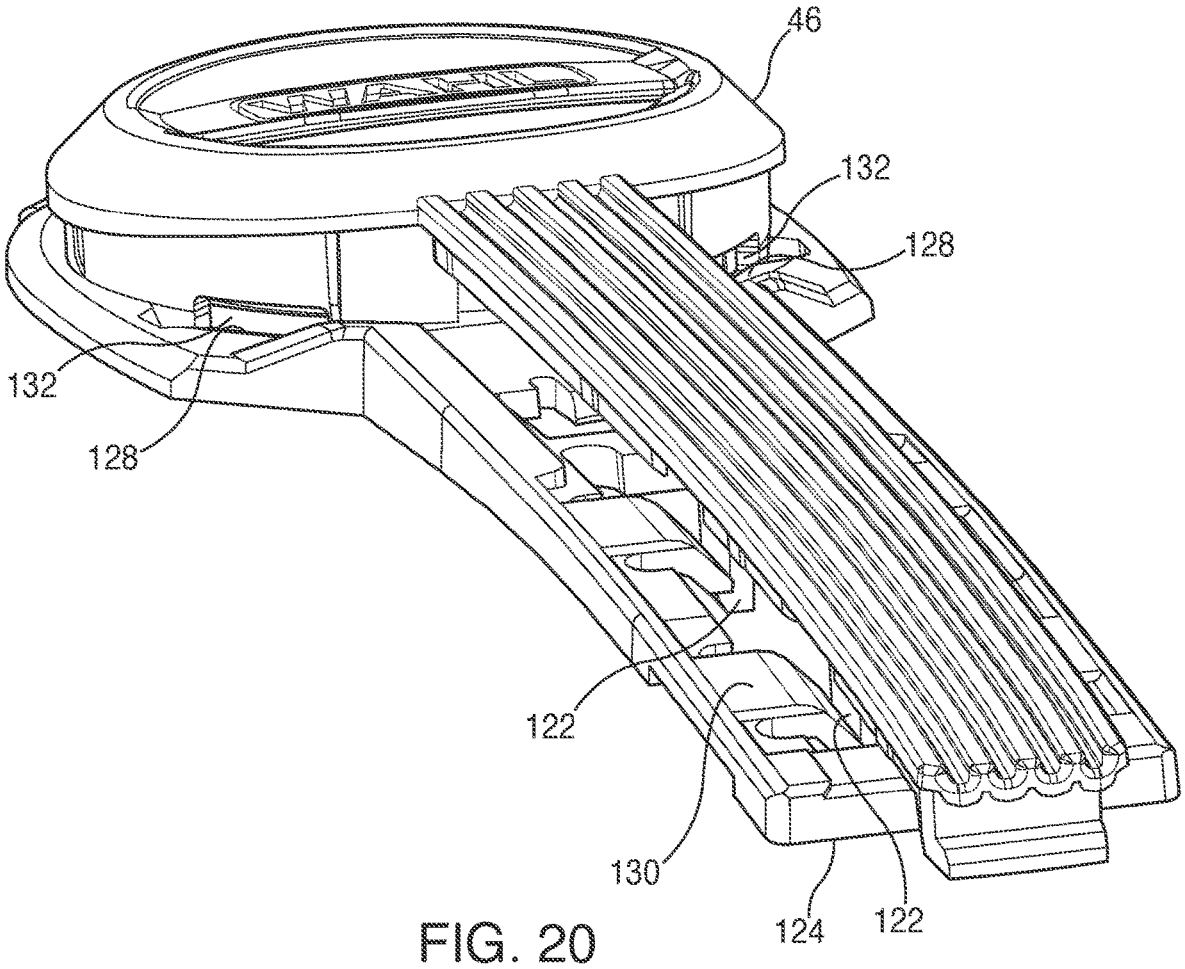
FIG. 20 is an enlarged, top perspective view of the element of FIG. 19.
Figure 21:
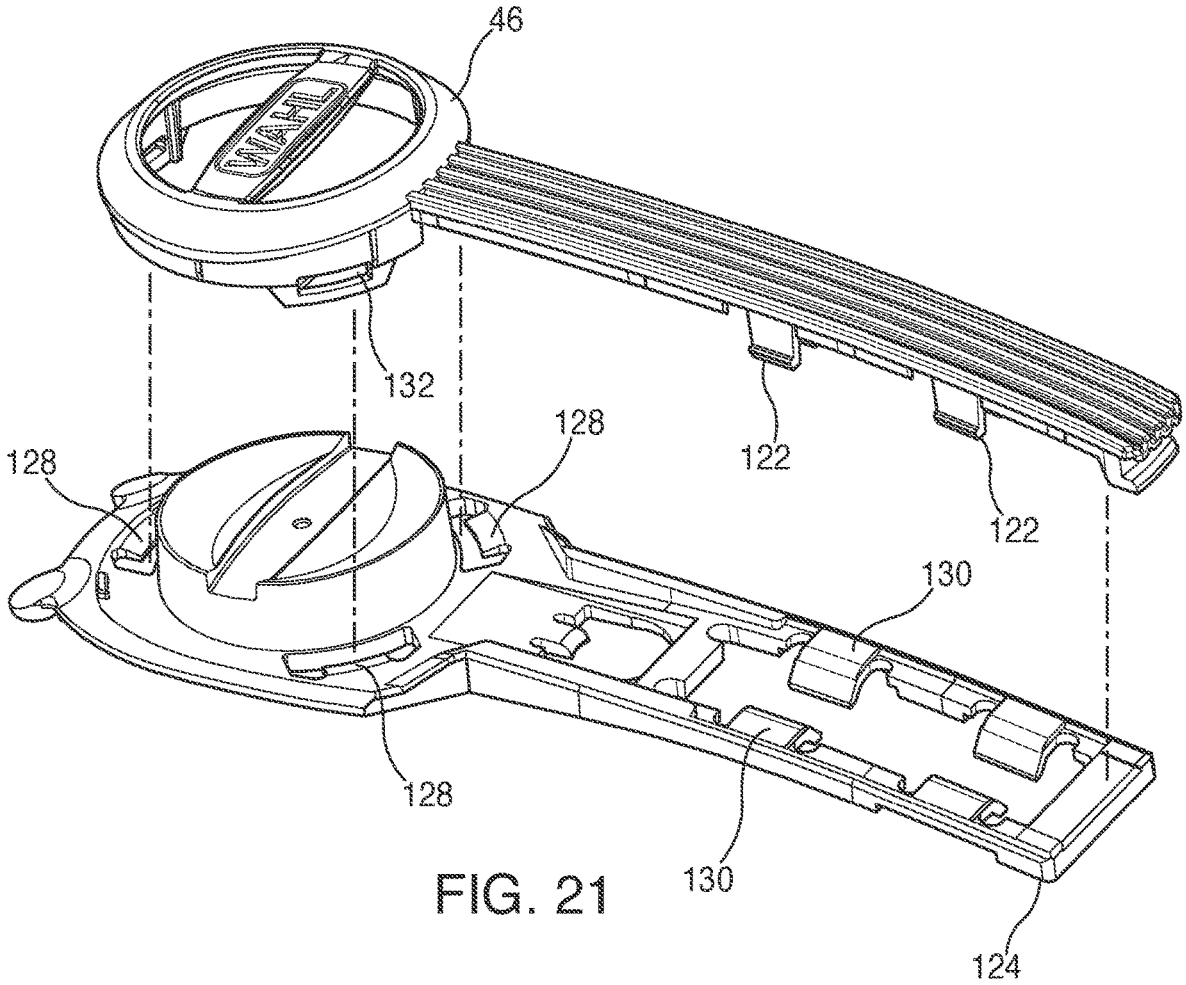
FIG. 21 is an exploded top perspective view of the ornamental design element of FIG. 19.

During assembly, the decorative piece 46 and the retainer 124 are secured to each other with the respective housing portion 22, 24 sandwiched therebetween. As such, the retainer 124 is provided with a complementary plurality of retaining projections 128, 130 constructed and arranged for engaging the hook projections 122. The plurality of retainer projections includes a first plurality of planar projections 128, and a second plurality of dog-legged projections 130, the latter configured for exerting a preloaded clamping force on the hook projections 122 (FIG. 20). Thus, the projections 130 exert a pulling or holding force against the decorative piece 46 which holds it in tight relationship with the housing portion 22, 24. The planar projections 128 are received in slots 132 in the decorative piece 46.

Figure 16:
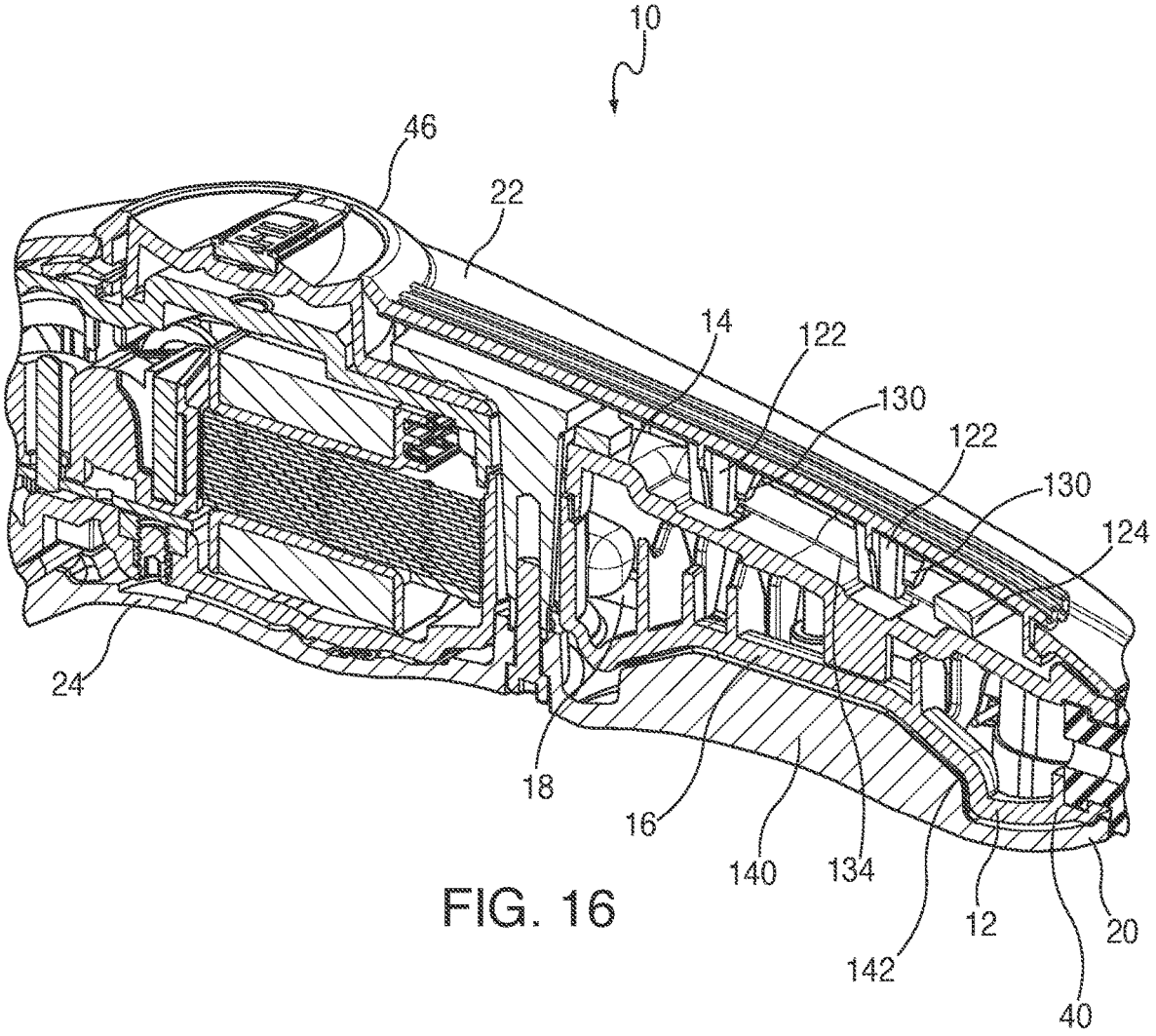
FIG. 16 is a vertical cross-section taken along the line 16-16 of FIG. 1 and in the direction generally indicated.
Figure 17:
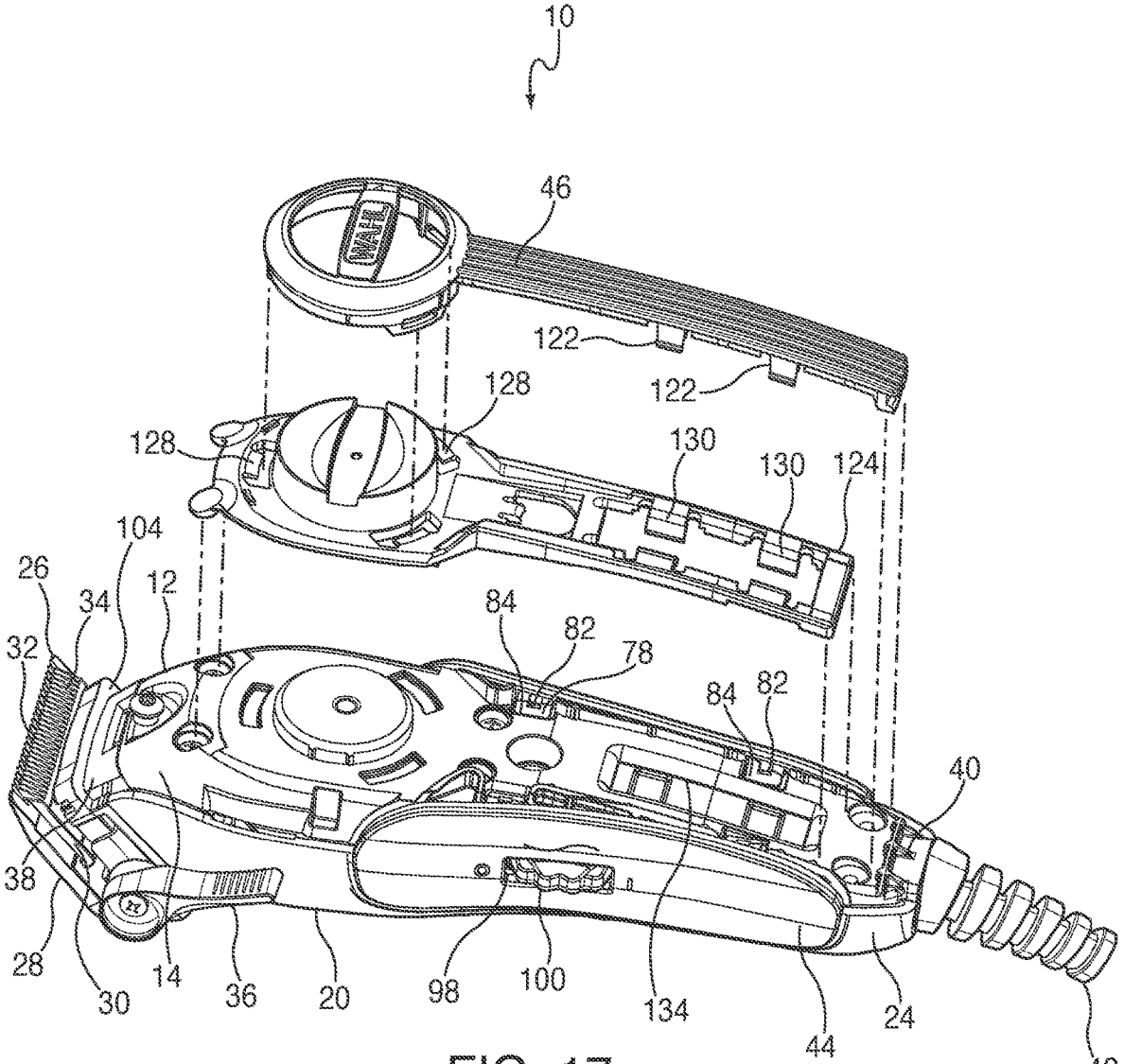
FIG. 17 is a partially exploded top perspective view of the hair clipper of FIG. 1 with portions omitted for clarity.
Figure 18:
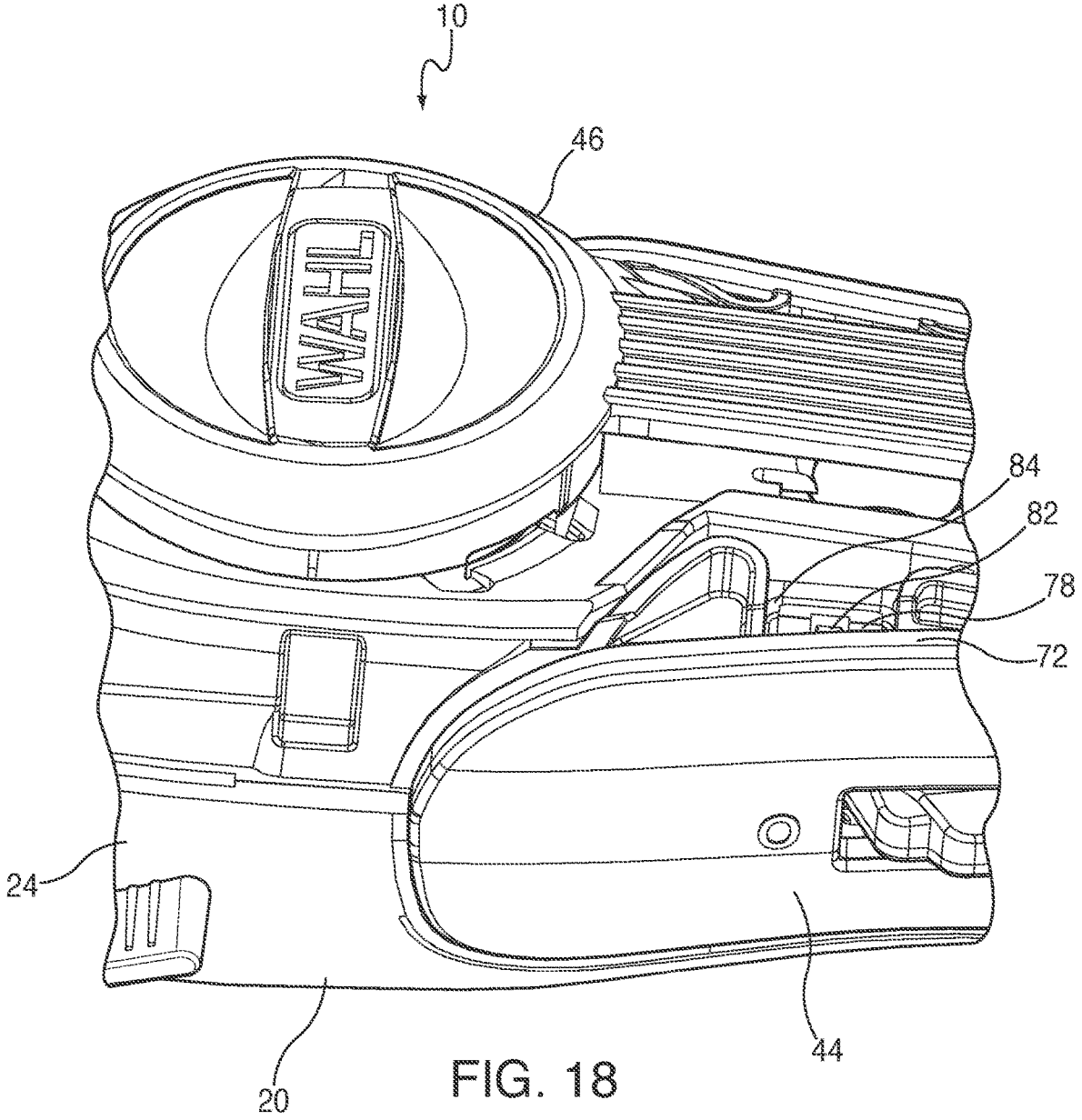
FIG. 18 is an enlarged fragmentary top perspective view of the hair clipper of FIG. 1 with portions omitted for clarity.
Figure 19:
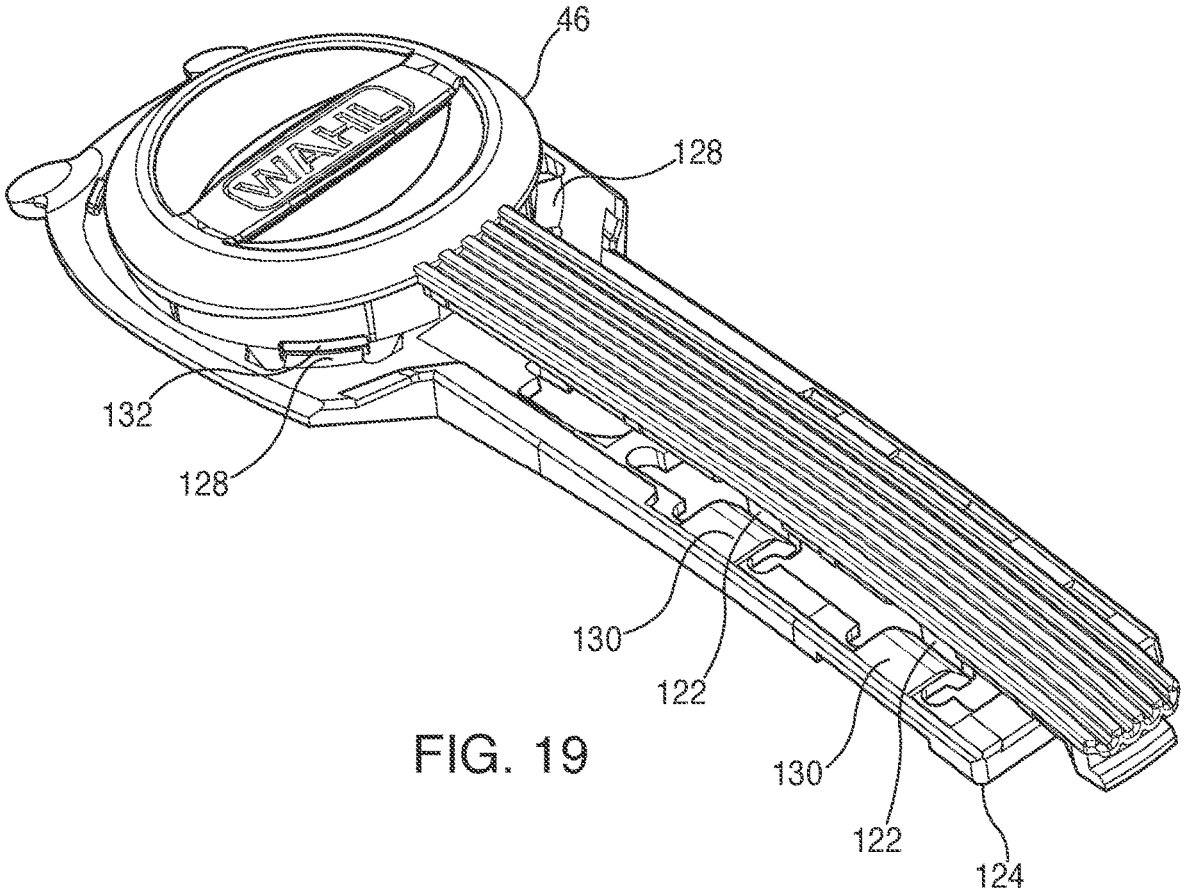
FIG. 19 is a top perspective view of the ornamental design element of the present hair clipper.

Referring now to FIGS. 8, 16 and 17, the chassis 12 is further provided with at least one projection recess 134 for accommodating the hook projections 122 and the retainer projections 128, 130 for a more secure location of the housing portions 22, 24 upon the chassis. In addition, the upper and lower housing portions 22, 24 are provided with at least one mounting boss 136 configured for projecting through complementary throughbores 138 in the chassis 12, so that fasteners passing through the bosses tightly retain the chassis between the upper and lower housing portions.

Referring now to FIG. 16, at least one of the housing portions 22, 24 includes at least one locating formation 140 projecting from an interior of the housing portion, and matingly engaging at least one complementary receiving formation 142 in the chassis. These formations 140 facilitate the location of the housing portions 22, 24 upon the chassis 12 during assembly of the hair clipper 10.

Figure 13:
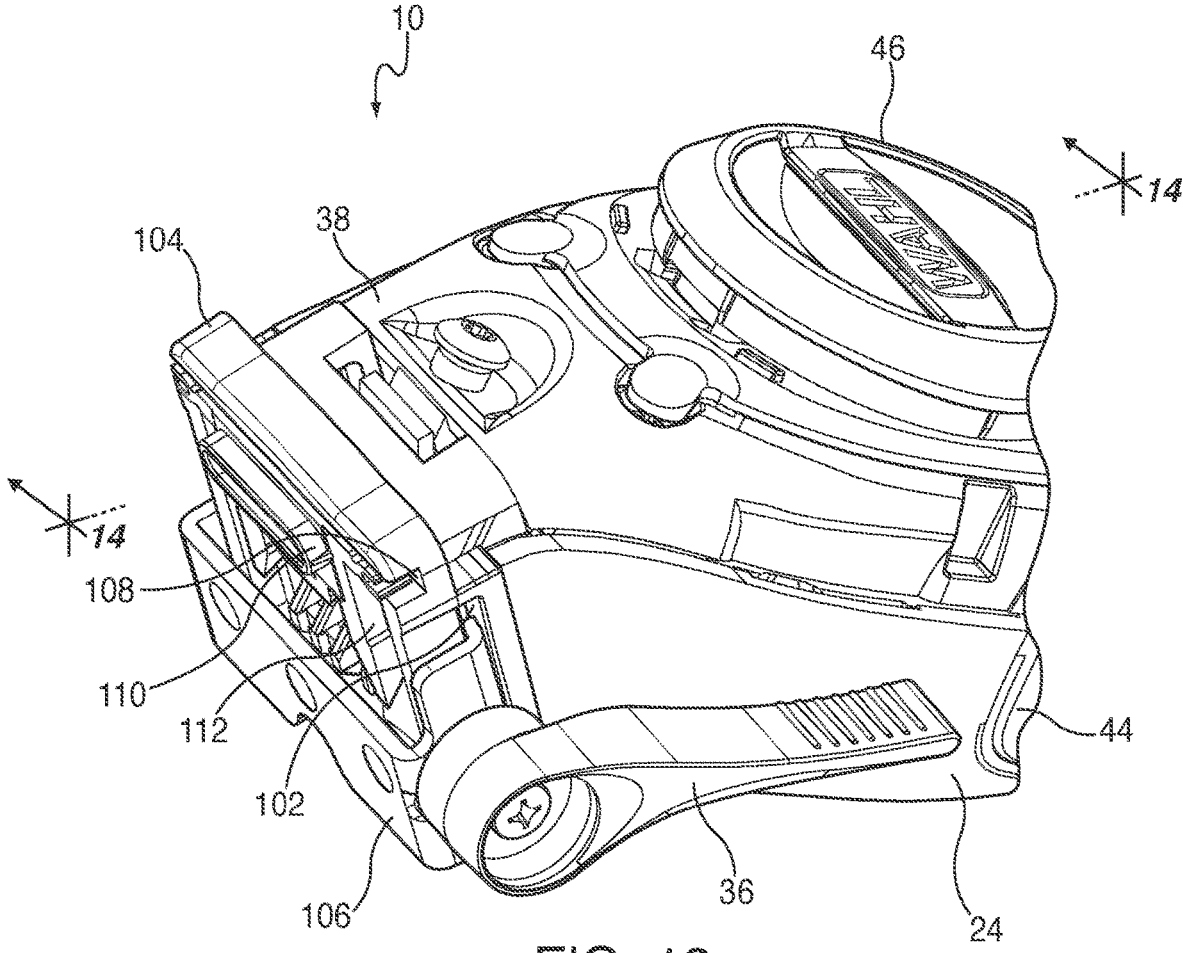
FIG. 13 is an enlarged, top perspective view of the hair clipper of FIG. 12.
Figure 14:
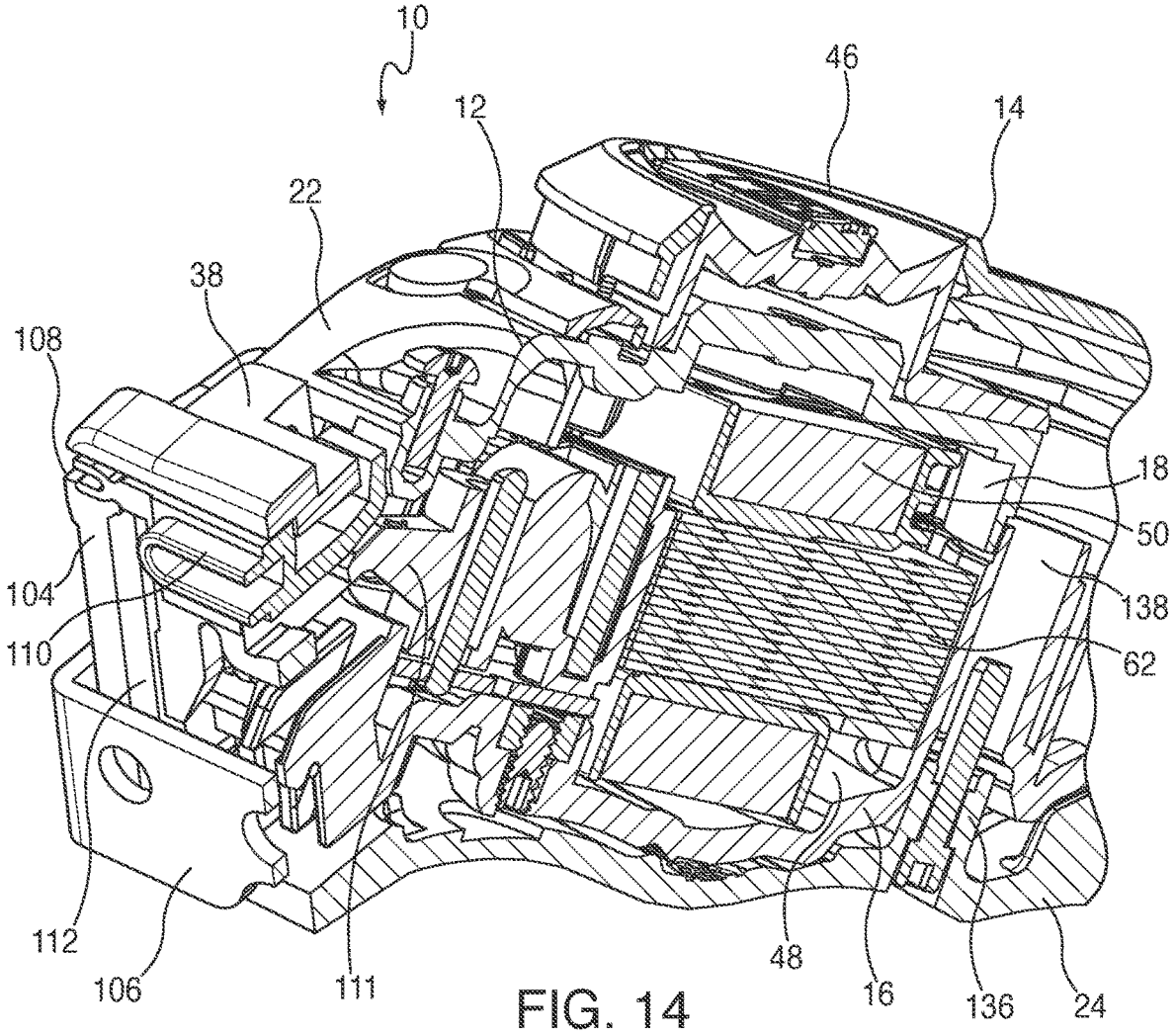
FIG. 14 is a cross-section taken along the lines 14-14 of FIG. 13 in the direction generally indicated.
Figure 15:
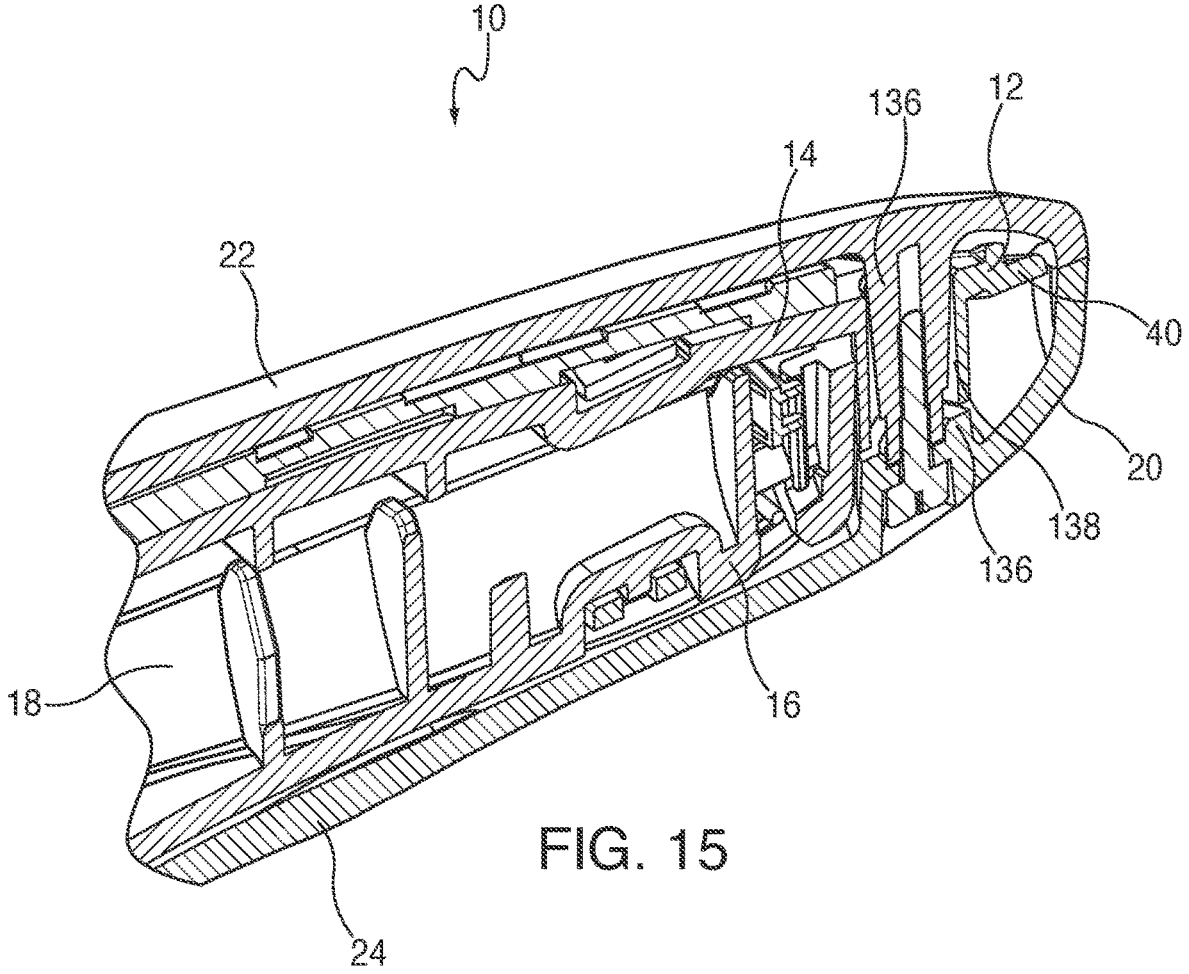
FIG. 15 is a fragmentary vertical cross-section taken along the line 15-15 of FIG. 1 and in the direction generally indicated.

Referring now to FIGS. 13 and 14, another feature of the present hair clipper 10 is that the cam follower 110 is slidably retained within the central opening 112 of the formation 104 for lateral reciprocal movement. Further, when the user opts to remove the bladeset 26 for maintenance, the engagement of the cam follower 110 in the formation 104 retains the cam follower in the operational position, so the user does not risk losing the component upon clipper disassembly.

More specifically, at an upper end 144 of the cam follower 110, a transverse bar 146 slidingly engages and laterally reciprocates in the travel path 108. Bifurcated or forked ends 148 of the transverse bar 146 exert a friction fit within with the travel path 108, and help to retain the cam follower 110 in position. Moving towards the rear end 40, a recessed, generally U-shaped saddle 150 is defined behind the transverse bar 146. A generally vertically-projecting tab 152 defines a rear end of the saddle 150.

The saddle 150 is dimensioned to slidingly engage an upper beam 154 of the formation 104 when the cam follower is operationally engaged on an end of the drive arm 111. The tab 152 is received in an opening 156 in the beam 154. In addition, a front face 158 of the cam follower includes a projection 160 that engages a slot (not shown) in the moving blade 30. During operation of the hair clipper 10, the pivoting drive arm 111 causes lateral reciprocation of the cam follower 110, which through the engagement of the projection 160, causes lateral reciprocation of the moving blade 30 relative to the stationary blade 28, causing cutting action.

When periodic maintenance of the bladeset 26 is needed, the user easily detaches the blades 28, 30, leaving the U-shaped slide bracket 106 in place. The cam follower 110 is held in place in the opening 112 through the engagement of the saddle 150 on the upper beam 154, and the presence of the bracket 106.

A method for assembling the hair clipper 10 includes providing the chassis 12 having upper and lower chassis portions 14, 16 defining an enclosed interior chamber 18, the upper and lower chassis portions configured for being secured together; providing the outer housing 20 including upper and lower housing portions 22, 24 constructed and arranged for enclosing the chassis as the housing portions are secured together such that the interior chamber is isolated from the housing; providing the chassis 12 with the first, blade end 38, and the second, rear end 40, and the blade end includes an integral blade guide channel 102. The blade guide channel 102 is incorporated into a formation 104 that defines a housing receiving surface 114 oriented at an oblique angle $\alpha$ to an axis defined by the chassis, and the lower housing portion has the angled front edge 116 that is slidably engaged along the housing receiving surface. The upper and lower housing portions 22, 24 are secured together so as to enclose the chassis 12.

While a particular embodiment of the present multi-piece hair clipper construction with metal housing has been described herein, it will be appreciated by those skilled in the art that changes and modifications may be made thereto without departing from the invention in its broader aspects and as set forth in the following claims.

The invention claimed is:

1. A hair clipper, comprising:

a chassis having upper and lower chassis portions defining an enclosed interior chamber, wherein said interior chamber includes a motor recess and said upper and lower chassis portions are configured for being secured together;

an outer housing including upper and lower housing portions constructed and arranged for enclosing said chassis as said housing portions are secured together such that said interior chamber is isolated from said housing;

a motor held in said motor recess through tight cooperation of complementary formations on said upper and lower chassis portions, wherein the cooperation of the complementary formations exerts a holding force on the motor to hold the motor in the motor recess; and a bladeset connected to the chassis, including a stationary blade and a moving blade that laterally reciprocates relative to the stationary blade through operation of the motor, causing a cutting action.

2. The hair clipper of claim 1, wherein said chassis is made of electrically insulative material, and said outer housing is made of metal.

3. The hair clipper of claim 1, wherein said complementary formations include crush ribs on one of said chassis portions, and depending wedges on the other of said chassis portions, said wedges being engaged in cavities in said crush ribs.

4. The hair clipper of claim 3, further including threaded fasteners used to secure said upper and lower chassis portions together also locating said motor in said motor recess.

5. The hair clipper of claim 1, further including resilient grip formations loosely connected to said chassis, and constructed and arranged to be compressed upon assembly of said upper and lower housing portions.

6. The hair clipper of claim 5, wherein said resilient grip formations are connected to said chassis by a hook and loop connection system.

7. The hair clipper of claim 6, wherein said hook and loop connection system includes at least one ramped hook on said chassis, and at least one complementary loop on each said resilient grip formation, each said hook being surrounding by a landing receiving said hook.

8. The hair clipper of claim 7, wherein said at least one complementary loop comprises two complementary loops with one projecting from an upper edge, and the other projecting from a lower edge of each said resilient grip formation.

9. The hair clipper of claim 7, wherein each said resilient grip form includes at least one supplemental gripping formation on at least one of a front end and a rear end of each said resilient grip formation, and said chassis is configured for receiving said at least one supplemental gripping formation in a snap-fit engagement.

10. The hair clipper of claim 1, wherein said chassis has a first end and a second end, and said first end includes an integral blade guide channel.

11. The hair clipper of claim 10, wherein said blade guide channel is incorporated into a formation that defines a housing receiving surface oriented at an oblique angle to an axis defined by said chassis for slidably receiving an angled front edge of one of said upper and lower housing portions.

12. The hair clipper of claim 10, wherein said blade guide channel is incorporated into a formation that defines a travel path for a cam follower of the hair clipper.

13. The hair clipper of claim 12, wherein said travel path extends transverse to a longitudinal axis of said chassis.

14. The hair clipper of claim 12, wherein said cam follower includes a saddle for slidably engaging an upper beam of said formation, said engagement of said saddle on said formation retaining said cam follower in said formation upon periodic removal of said bladeset fastened to said chassis.

15. The hair clipper of claim 14, wherein said saddle is defined by a transverse bar slidingly engaging said travel path, and a generally vertically-projecting tab.

16. The hair clipper of claim 15, wherein said tab is accommodated by an opening in said upper beam.

17. The hair clipper of claim 1, further including at least one decorative piece affixed to one of said upper and lower housing portions without the use of threaded fasteners.

18. The hair clipper of claim 17, wherein said decorative piece is provided with a plurality of hook projections extending into an interior of said clipper, which are snap-fit into a separate retainer positioned on an underside of said housing portion receiving said decorative piece.

19. The hair clipper of claim 18, wherein said retainer is provided with a complementary plurality of retaining projections constructed and arranged for engaging said hook projections.

20. The hair clipper of claim 19, wherein said plurality of retaining projections include a first plurality of planar projections, and a second plurality of dog-legged projections, the latter configured for exerting a preloaded clamping force on said hook projections.

21. The hair clipper of claim 19, wherein said chassis includes a projection recess for accommodating said hook projections and said retaining projections.

22. The hair clipper of claim 21, wherein at least one of said housing portions includes at least one locating formation projecting from an interior of said housing portion, and matingly engaging at least one complementary receiving formation in said chassis.

23. The hair clipper of claim 1, wherein said upper and lower housing portions are provided with mounting bosses configured for projecting through complementary throughbores in said chassis, so that fasteners passing through said bosses tightly retain said chassis between said upper and lower housing portions.

24. A hair clipper, comprising:

a chassis having upper and lower chassis portions defining an enclosed interior chamber, said upper and lower chassis portions configured for being secured together;

an outer housing including upper and lower housing portions constructed and arranged for enclosing said chassis as said housing portions are secured together such that said interior chamber is isolated from said housing;

said interior chamber includes a motor recess, and a motor held in said motor recess through tight cooperation of complementary formations on said upper and lower chassis portions, wherein the cooperation of the complementary formations exerts a holding force on the motor to hold the motor in the motor recess;

resilient grip formations loosely connected to said chassis, and constructed and arranged to be compressed upon assembly of said upper and lower housing portions; and a bladeset connected to the chassis, including a stationary blade and a moving blade that laterally reciprocates relative to the stationary blade through operation of the motor, causing a cutting action.

25. The hair clipper of claim 24, wherein said complementary formations include crush ribs on one of said chassis portions, and depending wedges on the other of said chassis portions, said wedges being engaged in cavities in said crush ribs.

26. The hair clipper of claim 24, wherein said resilient grip formations are connected to said chassis by a hook and loop connection system.

27. A method for assembling a hair clipper, comprising:

providing a chassis having upper and lower chassis portions defining an enclosed interior chamber, said upper and lower chassis portions configured for being secured together;

providing an outer housing including upper and lower housing portions constructed and arranged for enclosing said chassis as said housing portions are secured together such that said interior chamber is isolated from said housing;

providing said chassis with a first end, and a second, end, and said first blade end includes an integral blade guide channel;

said blade guide channel is incorporated into a formation that defines a housing receiving surface oriented at an oblique angle to an axis defined by said chassis; and said lower housing portion has an angled front edge that is slidably engaged along said housing receiving surface.

* * * * *